United States Patent [19]

Liska

[11] 4,311,437

[45] Jan. 19, 1982

[54] RADIAL PISTON PUMP

[75] Inventor: Georg Liska, Zimmerbach, Fed. Rep. of Germany

[73] Assignee: Zahnradfabrik Friedrichshafen, AG, Friedrichshafen, Fed. Rep. of Germany

[21] Appl. No.: 99,478

[22] Filed: Dec. 3, 1979

[30] Foreign Application Priority Data

Dec. 7, 1978 [DE] Fed. Rep. of Germany ..... 2852852

[51] Int. Cl.[3] ..... F04B 1/18; F04B 21/02

[52] U.S. Cl. ..... 417/273; 417/566

[58] Field of Search ..... 137/860, 512.15; 417/273, 566

[56] References Cited

U.S. PATENT DOCUMENTS

| | | | |
|---|---|---|---|
| 1,255,710 | 1/1961 | Zimmermann | 417/559 |
| 1,265,153 | 5/1918 | Winsor | 137/860 |
| 1,368,315 | 2/1921 | Wygodsky | 137/860 |
| 2,472,355 | 6/1949 | Wittingham | 417/273 |
| 3,729,021 | 4/1973 | Humphrey | 417/560 |
| 4,194,435 | 5/1970 | Gaun et al. | 137/860 |
| 4,214,607 | 7/1980 | Bouteille | 137/860 |

FOREIGN PATENT DOCUMENTS

| | | | |
|---|---|---|---|
| 2242435 | 3/1974 | Fed. Rep. of Germany | 417/273 |
| 2404762 | 8/1975 | Fed. Rep. of Germany | 417/273 |
| 2431938 | 1/1976 | Fed. Rep. of Germany | 417/273 |
| 2023719 | 1/1980 | United Kingdom | 417/273 |

*Primary Examiner*—William L. Freeh
*Attorney, Agent, or Firm*—Zalkind & Shuster

[57] ABSTRACT

An annular elastic valve element is deformed under fluid pressure to control flow of fluid from a piston chamber to a pressure chamber of a piston pump by separation from the peripheral wall surface of a valve seat at a location through which a passage bore extends. The valve seat overlies the outer end of the piston and its peripheral wall has reduced diameter portions spaced from the bore to accommodate elastic deformation of the valve element.

6 Claims, 5 Drawing Figures

RADIAL PISTON PUMP

BACKGROUND OF THE INVENTION

This invention relates in general to a radial piston pump construction and more particularly to a pressure sealing valve arrangement associated therewith.

The present invention resides in an improvement to a radial piston pump having spring-loaded plungers operated by a displacing element with which a valve is associated for sealing a piston chamber from a pressure chamber, the valve being seated on a valve seat member fixed to the pump housing. Piston pumps generally have several plungers which are disposed in radial or axial relation to the pump shaft. The desired pumping action is produced by a displacing element operating on the several plungers in a predetermined phase relationship during each revolution of the pump shaft. A normally closed valve is located between each plunger and the pressure chamber located upstream thereof to seal it from the piston chambers. Each valve is opened only during certain operational phases of its plunger to conduct pressure medium to the pressure chamber. Such sealing of the plungers is relatively expensive and the pressure sealing parts are difficult to assemble. The provision of a single band-shaped valve for all plungers to simplify the sealing arrangement has been proposed. However, such sealing arrangement requires the maintenance of a precise phase relationship between the plungers to avoid increased pulsations of the pump output. Furthermore, the valve seat in such a proposed arrangement must be reground after being installed with a press fit and a divided annular spring must be fixed in a precise angular position. For that reason, it has been proposed that a separate sealing valve be provided for each plunger. While the latter proposal avoids pulsations produced by out-of-phase operation of the individual plungers, the valve arrangement is considerably more expensive since it requires more parts and more space.

It is therefore an important object of the present invention to provide a piston pump with pressure sealing valves for the individual plungers to avoid disturbance of the operational phase relationship between plungers and to simplify the valve construction and assembly.

SUMMARY OF THE INVENTION

In accordance with the present invention, a valve seat member is formed in the shape of a cap overlying the radially outer end of each plunger and is provided with at least one pressure bore in its peripheral wall having an outer perimeter deviating from a circle at reduced diameter portions at which there are no pressure bores. An elastic annular valve element which is fitted over the peripheral wall of the valve seat, closes the pressure bore during no-flow phases of operation. As a result of the foregoing arrangement, a significant reduction in pressure pulsations is achieved and operational phase interference between individual plungers is avoided. The valve assembly furthermore has as fewer parts and manufacturing costs are lower. For example, the provision of a valve spring is avoided since the annular valve element performs the spring function. Also, periodic regrinding of the valve seat and positional adjustment of the valve assembly are not necessary.

The functioning of the valve assembly constructed in accordance with the present invention is made very simple. The annular valve element cooperates with the outer peripheral wall of the valve seat in such a fashion that during no-flow conditions, the pressure bore in the valve seat is closed by contact between the peripheral wall and the valve element. When the piston plunger is displacing the pressure medium, a separating force acts on the annular valve element in the region of the pressure bore. Inasmuch as the peripheral wall of the valve seat deviates from a circular form so as to have reduced diameter portions where no pressure bores are located, the annular valve element is deformed inwardly at those reduced diameter portions enabling the annular valve element to be separated from the valve seat at those portions at which the pressure bores are located. As a result thereof, the pressure medium is conducted through the pressure bores into the pressure chamber upstream of the valve element. Such separation between the peripheral wall and valve element occurs as a result of the elasticity of the valve element so that resetting of the valve element occurs automatically to close the pressure bores.

It has also been discovered that the valve assembly construction in accordance with the present invention exhibits a good aspiration behavior. Another advantage of the valve assembly resides in the fact that the valve seat function as a support for the piston spring as well as to seal the pressure chamber from the piston chamber of the plunger.

According to one embodiment of the present invention, the peripheral wall of the valve seat is in the shape of an oval or ellipse at its outer perimeter so that the pressure bore is located at the major axis of the ellipse. In such a construction, the annular valve element may be elastically deformed from a perfectly circular shape in its undeformed condition. The deformation of the annular valve element is determined by the difference between the major axis of the eliptical perimeter of the peripheral valve seat wall where it intersects the pressure bore and the shorter minor axis of the ellipse. A similar action is achieved with other shapes for the peripheral wall of the valve seat.

According to another embodiment of the invention, the peripheral wall of the valve seat is formed with flats on its outer surface disposed in perpendicular relationship to the pressure bore on both sides thereof. In this embodiment, the construction of the valve seat will be simplified since it may be produced as a cylindrical part that is machined in a simple manner by milling, for example, to form the flats. Alternatively, the flats may be formed by a cold forging method.

According to a still further embodiment of the invention, a peripheral wall of the valve seat may advantageously be formed as a triangle with the pressure bores being located on the angle portions of the triangle. In the latter embodiment of the invention, the annular valve element will have sufficient space into which it may be deformed from the radially outer angle portions of the triangle.

BRIEF DESCRIPTION OF THE DRAWING FIGURES

Various embodiments of the invention are hereinafter described in greater detail, by way of example, with reference to the accompanying drawings in which.

DETAILED DESCRIPTION OF PREFERRED EMBODIMENTS

Figure 1:
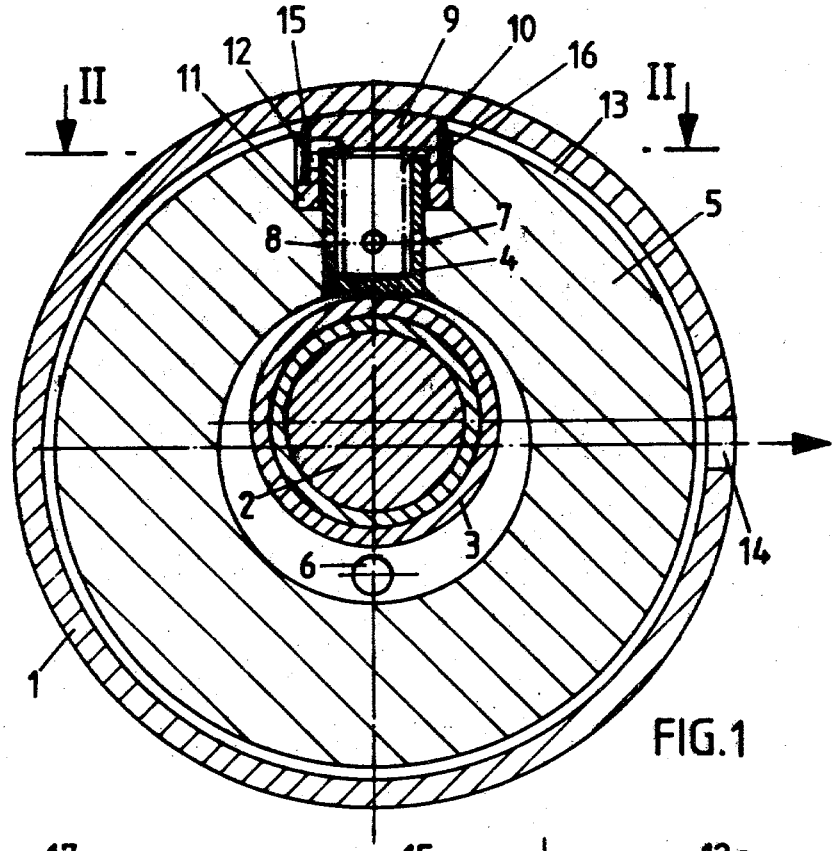
FIG. 1 is a transverse section view through a radial piston pump constructed in accordance with the present invention.

Referring now to the drawings in detail, FIG. 1 illustrates a radial piston pump constructed in accordance with the present invention having an outer cylindrical housing 1. Rotatably mounted within the housing is a pump shaft 2 having an eccentric element 3 rotatably mounted thereon for operation of a plunger or piston 4. Although a single piston 4 is shown for sake of simplicity, it will be appreciated that a plurality of such pistons may be provided. The piston is guided for radial displacement within a piston carrier 5. A bore 6 is formed at one axial end of the housing 1 through which an inflow of pressure medium is conducted filling the space disposed radially between the piston carrier 5 and eccentric element 3 for the relative positions of the eccentric 3 and piston carrier as shown.

The piston 4 at its radially outer end is sealed by a valve seat; 9 formed in the shape of a cap. The valve seat 9 also supports a piston spring 10 extending axially into the piston chamber enclosed by the piston. The inner axial end 11 of the valve seat is received in a recess in piston carrier 5 with a press bit. A pressure passage or bore 12 is formed in a cylindrical wall portion 16 of the valve seat cap in order to establish fluid communication between the interior piston chamber of the piston and an annular pressure chamber 13 formed between the internal surface of the cylindrical housing 1 and the external cylindrical surface of the piston carrier 5. Fluid is drained from the annular pressure chamber 13 through a bore 14 formed in the housing 1. An annular valve element 15 made of an elastic material is externally mounted on the valve seat 9 surrounding its peripheral wall portion 16 through which the pressure bore 12 extends in order to control the flow of fluid between the pressure bore 12 and the annular chamber 13.

For sake of clarity, the piston 4 has been omitted from FIGS. 2 through 5 showing the pump in different operational positions. It will be apparent from FIGS. 2 and 3, that the peripheral wall portion 16 of the valve seat has an epilitical shape with the pressure bore 12 lying on the larger axis of the ellipse. The annular valve element 15, on the other hand, is circular in shape and has an inside diameter dimensioned to fit against the external surface of the peripheral portion 16 of the valve seat where the larger axis intersects. In this way, sealing of the pressure bore is assured whenever the piston element 4 is not in use.

Figures 2, 3, 4, 5:
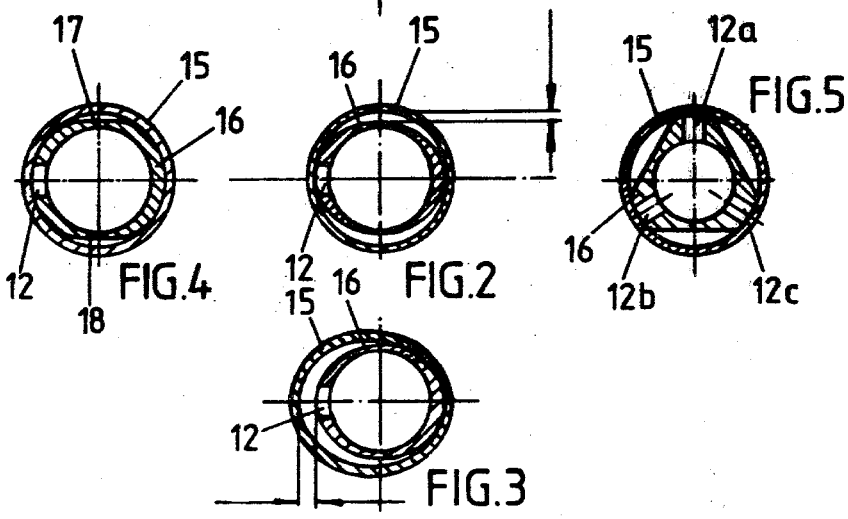
FIG. 2 is a partial section view taken substantially through a plane indicated by section line II—II in FIG. 1.
FIG. 3 is a partial section view similar to that of FIG. 2 but showing another operational phase.
FIG. 4 is a partial section view similar to that of FIG. 2 but showing another embodiment of the sealing valve in accordance with the present invention.
FIG. 5 is a partial section view similar to that of FIG. 2 but showing a still further embodiment in accordance with the present invention.

During operation of the pump when the piston compresses a fluid medium, the annular valve element 15 as more closely seen in FIG. 3 is deformed by the pressurized fluid to unseal the pressure bore 12 as a result of which the pressure fluid is conducted into the annular pressure chamber 13. The gap 20 between the wall portion 16 and the valve element 15 required for flow of fluid to chamber 13 will develop as a result of the fact that the annular valve element 15 is elastic and also because of the eliptical shape of the valve seat effecting a corresponding deformation of the annular valve element as shown in FIG. 3.

FIG. 4 illustrates a modification of the arrangement shown in FIGS. 2 and 3 wherein the shape of the peripheral wall portion 16 of the valve seat 9 is circular and is provided with flats 17 and 18 spaced 90° from the pressure bore 12. As a result of this arrangement, the annular valve element 15 will separate from the peripheral portion 16 of the valve seat at the pressure bore 12 during operation of the pump.

FIG. 5 shows another embodiment in which the peripheral wall portion 16 of the valve seat is provided with several pressure bores 12*a*, 12*b* and 12*c*. The peripheral wall portion in this embodiment is formed in the shape of a triangle wherein the pressure bores are disposed between the sides of the triangle. The annular valve element 15 is circular and is deformed toward the flat sides of the wall portion 16 during operation of the pump to separate from the peripheral wall of the valve seat at the pressure bores. The valve seat 9 may be produced as a sintered part or as a part forged by cold impact. It is also possible to produce the valve seat by an automated machining process. Also, it will be appreciated that the shape of the peripheral wall 16 of the valve seat could be made in the form of other shapes than those specifically described. It is merely necessary that the peripheral wall have a reduced diameter portion by means of which the annular valve element 15 will undergo deformation in order to separate therefrom at the pressure bore during operation of the pump.

The annular valve element 15 may be merely a cutoff section of a circular conduit made of a material having elastic properties. Thus, it will be apparent that the valve associated with the radial piston pump may be produced with fewer and simpler parts in accordance with the present invention. Also, assembly of the pump is facilitated. Assembly consists essentially of press fitting the valve seat 9 into a piston carrier recess and fitting the annular valve element over the valve seat. The angular position of the pressure bore 12 in the valve seat may be arbitrarily selected.

It was also discovered that the foregoing arrangement of the present invention exhibits a good aspiration behavior and that the piston pump is self ventilating. In the embodiment of the invention as shown in FIGS. 1, 2 and 3, automatic removal of any air present in the pump is effected.

What is claimed is:

1. In a piston pump having a housing (1) enclosing a carrier (5) within which at least one piston (4) is mounted for displacement of fluid from a piston chamber to a pressure chamber (13) the improvement comprising a valve seat member (9) fixed to the housing in overlying slide bearing relation to the piston having a peripheral wall (16) within which a pressure passage (12) is formed establishing fluid communication between the piston chamber and the pressure chamber, and elastic valve means (15) mounted on the peripheral wall of the valve seat member for controlling flow of fluid through said passage in response to elastic deformation relative to the peripheral wall under pressure of the fluid, said peripheral wall having an outer perimeter that deviates from a circle to reduce diameter portions spaced from said passage, said valve means being deformed toward the reduced diameter portions of the peripheral wall to open the passage.

2. The piston pump as defined in claim 1, wherein said reduced diameter portions of the peripheral wall are flats spaced 90° from the pressure passage.

3. The piston pump as defined in claim 1, wherein the peripheral wall is triangular in cross-section having angle portions at which a plurality of the pressure passages (12*a*, 12*b*, 12*c*) are located.

4. The piston pump as defined in claim 1, wherein said elastic valve means comprises an annular valve element in contact with said peripheral wall at said reduced diameter portions and other locations, respectively, in deformed and undeformed states thereof.

5. The piston pump as defined in claim 4, wherein said valve element in the undeformed state contacts the peripheral wall at the other locations closing the passage to block flow of fluid.

6. In a piston pump having a spring-loaded plunger (4) enclosing a piston chamber and operated by a displacing element (3) to supply pressurized fluid from the piston chamber to a pressurized chamber (13) enclosed by a pump housing (1), the improvement residing in means attached to the housing for sealing the piston chamber from the pressure chamber, comprising a valve seat element (9) overlying the plunger in slide bearing relation having a peripheral wall (16) within which a pressure bore (12) is formed to establish fluid communication between the piston chamber and the pressure chamber, said peripheral wall deviating from a circle at reduced diameter portions spaced from said pressure bore, and elastic valve means (15) mounted on the peripheral wall of the valve seating element for closing the pressure bore to block flow of fluid therethrough, said peripheral wall being elliptical in cross-section and having a major axis extending through said pressure bore.

* * * * *